US011549244B2

(12) United States Patent
Alteon

(10) Patent No.: US 11,549,244 B2
(45) Date of Patent: Jan. 10, 2023

(54) MULTIFUNCTIONAL SMART FAUCET

(71) Applicant: Renande Alteon, Brockton, MA (US)

(72) Inventor: Renande Alteon, Brockton, MA (US)

( * ) Notice: Subject to any disclaimer, the term of this patent is extended or adjusted under 35 U.S.C. 154(b) by 231 days.

(21) Appl. No.: 17/103,728

(22) Filed: Nov. 24, 2020

(65) Prior Publication Data

US 2022/0162838 A1 May 26, 2022

(51) Int. Cl.
*E03C 1/05* (2006.01)
*E03C 1/046* (2006.01)

(52) U.S. Cl.
CPC ..... *E03C 1/057* (2013.01); *E03C 1/046* (2013.01); *Y10T 137/9464* (2015.04)

(58) Field of Classification Search
CPC ..... E03C 1/0404; E03C 1/046; E03C 1/057; Y10T 137/9464
USPC ..... 251/6, 7, 10
See application file for complete search history.

(56) References Cited

U.S. PATENT DOCUMENTS 1,497,726 A * 6/1924 Keenan ..... F16K 1/36 251/355
1,640,408 A * 8/1927 House ..... F04B 53/102 137/329.04
1,777,453 A * 10/1930 Seery ..... E03C 1/046 137/895
2,002,783 A * 5/1935 Long ..... F16K 15/00 137/533.19
2,521,961 A * 9/1950 Flavius ..... B05B 11/3001 417/547
2,755,816 A * 7/1956 Collins ..... F16K 15/063 137/496
2,888,217 A * 5/1959 Zierden ..... B65H 75/364 242/407
3,090,564 A * 5/1963 Gilmour ..... B05B 7/12 251/207
3,134,545 A * 5/1964 Armond ..... E03C 1/046 239/443
3,178,118 A * 4/1965 New ..... B05B 7/30 239/10
3,438,393 A * 4/1969 Godley ..... B29C 45/52 137/533.17

(Continued)

FOREIGN PATENT DOCUMENTS

EP 0 616 658 B1 10/1997
WO 2014075456 5/2014

*Primary Examiner* — Daphne M Barry
*Assistant Examiner* — Frederick D Soski
(74) *Attorney, Agent, or Firm* — Lambert Shortell & Connaughton; David J. Connaughton, Jr.; Justin P. Tinger

(57) ABSTRACT

The present disclosure relates to multifunctional smart faucets able to dispense a plurality of cleaning and personal hygiene liquids. In accordance with aspects and embodiments, a multifunctional smart faucet system is provided comprising a faucet that, in addition to having traditionally plumbed hot and cold water lines, includes a plurality of reservoirs, each of the plurality of reservoirs having a reservoir channel extending from the reservoir through the body of the faucet. The faucet systems disclosed includes a manual push button able to dispense fluids in the reservoirs, as well automated systems for dispensing fluids on intervals and according to pre-determined programming. In some embodiments, the disclosed smart faucet systems are controllable by smart devices with the aid of a dedicated application.

18 Claims, 4 Drawing Sheets

(56) References Cited

U.S. PATENT DOCUMENTS 3,513,875 A * 5/1970 Nelson ..... F16K 7/00 137/533.19
4,643,222 A * 2/1987 Wiser ..... F16K 15/02 137/533.17
5,014,729 A * 5/1991 Sepso ..... F25B 41/38 137/513.3
5,186,021 A * 2/1993 Keller ..... F25B 41/38 137/625.33
5,765,242 A * 6/1998 Marciano ..... E03C 1/057 4/628
5,781,942 A 7/1998 Allen
5,836,482 A * 11/1998 Ophardt ..... A47K 5/1202 222/325
5,857,594 A * 1/1999 Ozturk ..... E03C 1/046 4/675
5,894,741 A * 4/1999 Durham ..... F25B 41/38 137/513.3
5,966,753 A 10/1999 Gauthier
6,093,313 A * 7/2000 Bovaird ..... B01D 35/04 137/551
7,406,722 B2 8/2008 Fukuizumi
7,458,523 B2 12/2008 Hyslop
7,647,653 B1 1/2010 Catania
7,770,244 B2 * 8/2010 Yeh ..... E03C 1/04 239/289
7,783,380 B2 8/2010 York
8,096,530 B2 * 1/2012 Pelfrey ..... A47K 5/16 222/145.5
10,060,775 B2 8/2018 Ruiz Cortez
10,428,498 B1 10/2019 Montague
2004/0069802 A1 * 4/2004 Frankel ..... E03C 1/046 222/631
2004/0159355 A1 * 8/2004 Vasilev ..... F16K 15/02 137/528
2004/0163714 A1 * 8/2004 Sueda ..... F16K 15/021 137/533
2005/0133100 A1 6/2005 Bolderheij
2006/0101575 A1 * 5/2006 Louis ..... E03C 1/046 4/676
2006/0201332 A1 * 9/2006 Klopfenstein ..... B01F 35/713 261/78.1
2006/0233921 A1 * 10/2006 Mock ..... B65D 85/8055 426/106
2006/0289819 A1 * 12/2006 Parsons ..... E03C 1/057 251/129.04
2007/0119980 A1 * 5/2007 Somerfield ..... E03C 1/046 239/398
2007/0152082 A1 * 7/2007 Hyslop ..... A47K 5/14 239/428
2007/0157978 A1 * 7/2007 Jonte ..... E03C 1/057 137/613
2008/0301869 A1 * 12/2008 Mock ..... E03C 1/046 4/615
2009/0000024 A1 * 1/2009 Louis ..... E03C 1/046 222/1
2009/0049599 A1 * 2/2009 Parsons ..... E03C 1/057 250/221
2009/0056011 A1 * 3/2009 Wolf ..... E03C 1/057 4/623
2009/0100593 A1 * 4/2009 Lincoln ..... E03C 1/057 4/623
2009/0145926 A1 * 6/2009 Klopfenstein ..... B67D 1/07 222/383.2
2009/0272445 A1 * 11/2009 Shimizu ..... E03C 1/0404 251/129.01
2010/0051719 A1 * 3/2010 Carlucci ..... B05B 7/2464 239/316
2010/0139798 A1 * 6/2010 Schooley, Jr. ..... B05B 1/18 137/893
2010/0200087 A1 * 8/2010 Andrews ..... F16K 11/044 137/533.17
2010/0213279 A1 * 8/2010 Frederick ..... B05B 7/2464 222/23
2012/0255619 A1 10/2012 Librus
2014/0259382 A1 9/2014 Dobizl et al.
2015/0034537 A1 * 2/2015 Parish, Sr. ..... B67D 1/0043 210/101
2015/0083748 A1 3/2015 McHale
2015/0101121 A1 * 4/2015 Burgo, Sr. ..... A47K 5/12 4/668
2015/0223646 A1 8/2015 Wegelin et al.
2017/0107704 A1 4/2017 Wang
2017/0128960 A1 5/2017 D'Urso
2017/0138025 A1 5/2017 Burgo, Sr.
2017/0260722 A1 9/2017 Horwitz
2019/0145533 A1 * 5/2019 Pirutin ..... F16K 11/087 137/896
2020/0199856 A1 6/2020 Davis

* cited by examiner

MULTIFUNCTIONAL SMART FAUCET

FIELD OF DISCLOSURE

The present disclosure relates to faucets, and more specifically to multifunctional faucet systems able to dispense a plurality of liquids. The disclosed multifunctional faucet systems may be manually switched from dispensing one liquid to another or, in some embodiments, may be instructed to switch from one liquid to another based on pre-selected programming. In some embodiments, the programming may be selected remotely. The disclosed multifunctional smart faucet systems advantageously dispense a plurality of cleaning, sanitizing, and self-care liquids and are programmable to meet a user's needs, thus offering hands free and/or time saving solutions to daily cleaning tasks.

BACKGROUND

Many diseases are spread from one person to another through contact, whether direct or indirect. Many contagia are spread by contact, directly or indirectly with the hands. Some contagia can be destroyed through the use of water and cleansing agents, such as soaps, antiseptic agents, and the like. Hand washing is thus central to controlling the spread of disease and maintaining good hygiene, both on a personal and at public level.

Household sinks often serve as the central hub for handwashing and the cleaning of other household items. These sinks, in addition to being used for hand washing, may be used to wash dishes, clothes, and other soiled items. As a result, these sinks may have around their basins several different types of soaps, sanitizer for use when the sink is occupied, and other items, including hand lotion for use after hand washing or sanitizing. These items take up space around the sink basin and each time they are accessed, they must be touched, creating a point of contact where germs can be spread from one individual to another. Moreover, in the case of certain activities, soap must be periodically dispensed onto soiled items. This lengthens the time required to complete cleaning. Moreover, if the water is left running while soap is accessed, water is wasted.

There thus exists a need for a multifunctional faucet that is able to disperse a plurality of fluids such that different individual fluids need not be individually stored and accessed on a sink basin. The present disclosure solves this problem by providing a multifunctional smart faucet that connects to a plurality of fluid reservoirs and is able to dispense a plurality of fluids through a single faucet head. The dispensing of a given fluid may be selected manually, or a by one or more predetermined programs. The disclosed smart faucet may have one or more stored predetermined programs in an on-board computer memory that can be selected by engaging with an interface on the faucet that caused the faucet to dispense fluids from the reservoirs in accordance with the program. In some embodiments, the faucet may be controlled by an external device in wireless communication with the faucet. The disclosed faucet may, for example, be controlled by a smart phone application. The smart phone application may have a designated set of programs from which a user can select or may allow a user to design their own programs for operation of the smart faucet.

SUMMARY OF DISCLOSURE

The present disclosure relates to faucet systems, and more specifically, to multifunctional smart faucet systems. In accordance with aspects and embodiments, a multifunctional smart faucet system is provided comprising a faucet plumbed to a cold water line and a hot water line, and a plurality of fluid reservoirs. The smart faucet further includes a manual push button capable of communicating with the water lines and the reservoirs. The system may have any number of reservoirs, but most preferably has three or four reservoirs, and these reservoirs are most preferably filled with soaps, hand sanitizer, and hand lotion.

In some embodiments, one of the reservoirs may have a timer, and the timer facilitates the periodic dispensing of the liquid in the reservoir. For example, the timer may periodically dispense dish soap to aid in dish washing. In some embodiments, the soap may be dispensed with the flow of water. In other embodiments, the flow of water may be stopped via a valve when the soap is dispensed. The faucet may include a manual push button that can be toggled to any of the reservoirs and depressed to dispense the fluid in the corresponding reservoir.

In accordance with aspects and embodiments, a multifunctional smart faucet system is provided having a computer in communication with the reservoirs. The computer includes a memory and a processor. The processor is configured to execute at least one faucet operation program stored on the memory. The faucet operation programs stored on the memory cause the faucet to operate in certain manners, dispensing fluids in the reservoirs according to programming. The programs stored in the memory are selected by an interface on the faucet.

In some embodiments, the multifunctional smart faucet can be controlled by an application run from a wireless device. The wireless device may be a smart phone, and the smart phone application may allow a user to select and run pre-stored faucet operation programs and allow a user to create and execute new faucet operation programs.

DETAILED DESCRIPTION

The disclosed multifunctional faucets advantageously disperse a plurality of fluids, enabling external sources of these fluids to be removed from sink basins and countertops. This not only saves valuable counterspace but also creates a more hygienic environment by reducing the number of surfaces that are touched when cleaning and handwashing is performed. The disclosed multifunctional faucets may further include features that automatically result in the dispensing of certain liquids at certain times. In some embodiments, the multifunctional faucets may include on-board computer systems able run, and thus automate, operation of the faucet. Still further, the disclosed multifunctional faucets may, in some embodiments, be controlled remotely by an external device, such as a smart phone or computer. The faucet of the present disclosure may be used with any type of faucet or spout, including, but not limited to a kitchen, bathroom (with, for example, additional toothpaste and mouthwash), or other sink faucet, in hair studios for washing hair (to dispense shampoo, conditioner, and other hair and/or skin product), in a shower head, bathtub spout, and the like.

In accordance with aspects and embodiments, a multifunctional smart faucet system 1000 is provided having faucet 100. Faucet 100 has base 10A and dispensing end 10B. Faucet 100 communicates with cold water line 105 and hot water line 115, both of which extend through the body of faucet 100 (for simplicity, these plumbing lines are not shown) to dispense water from dispensing end 100B. Cold water line 105 and hot water line 115 are in communication with and controlled by controller 110. The flow of water from faucet 100 and end 100B is similarly controlled by controller 110. Though controller 110 is shown as a single pivoting lever which opens a valve, controller 110 may be any other controller in any other form, including a hot water knob and a cold water knob which open a valve or valves. In some embodiments, the flow and temperature of water may be controlled instead by one or more motion or touch sensors incorporated into the faucet itself which open a valve.

Figure 2:
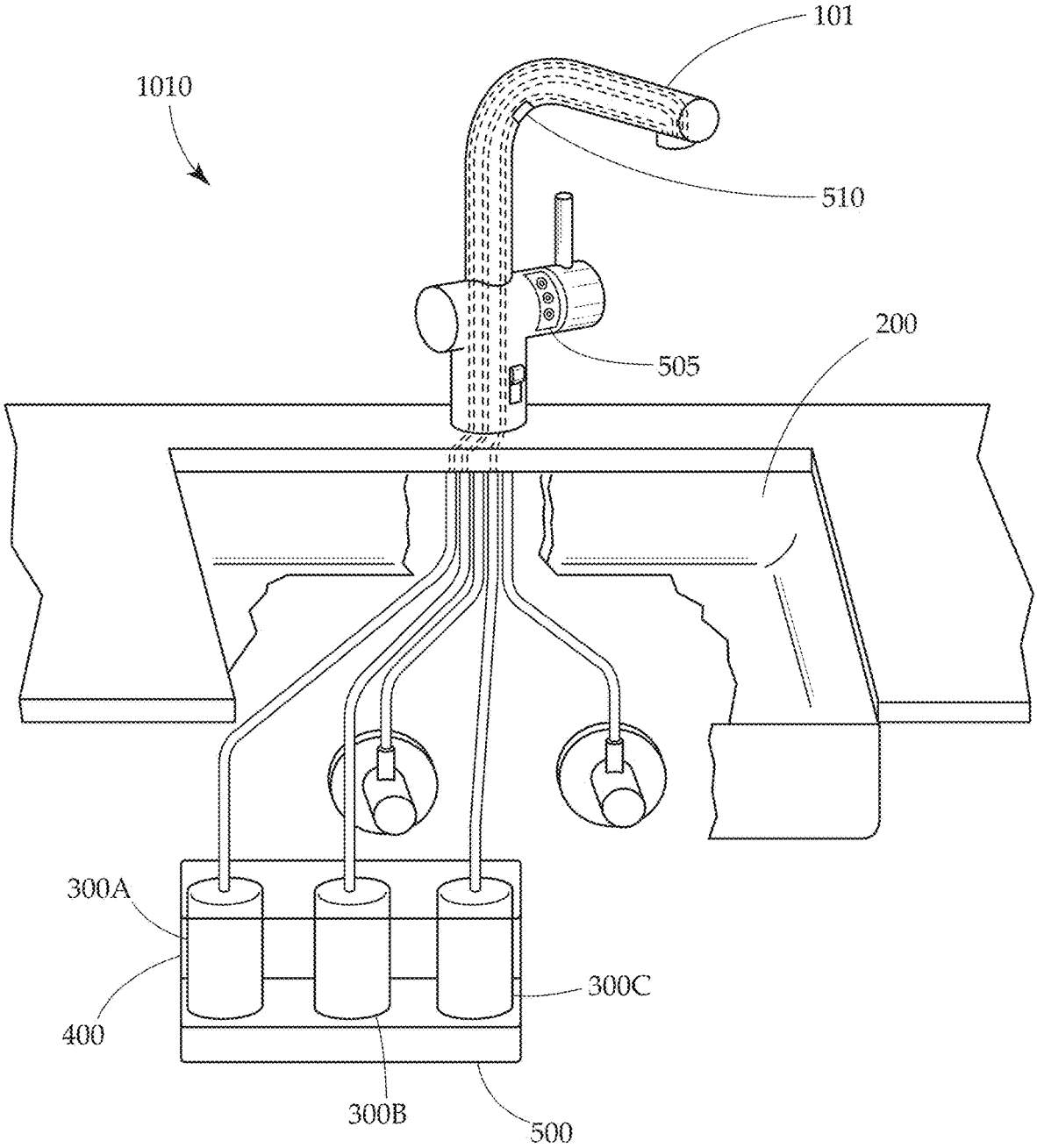
FIG. 2 shows a multifunctional smart faucet in accordance with aspects and embodiments.

Faucet system 1000 includes a plurality of reservoirs 300A, 300B, and 300C positioned under sink 200. In some embodiments, reservoirs 300 may be mounted to a surface below sink 200 and above the ground/floor. In other embodiments, reservoirs 300 may rest on a flat surface, such as the ground or a cabinet floor, below sink 200. In other embodiments and as shown in FIG. 2, reservoirs 300 may be positioned in a housing.

Reservoirs 300A, 300B, and 300C are connected to corresponding channels 305A, 305B, and 305C, which include a pump system (not shown). Channels 305A, 305B, and 305C extend from each respective reservoir and through the body of faucet 100 such that the fluid contained in each respective reservoir can be dispensed from dispending end 100B of faucet 100. Reservoirs 300A, 300B, and 300C may contain a variety of cleaning, personal hygiene, and selfcare fluids, including but not limited to hand soap, dish soap, hand sanitizer, and hand lotion. Reservoirs 300 may be removably connected to channels 305 so that reservoirs 300 can be disconnected and removed from system 1000 for easy refilling.

Figure 1:
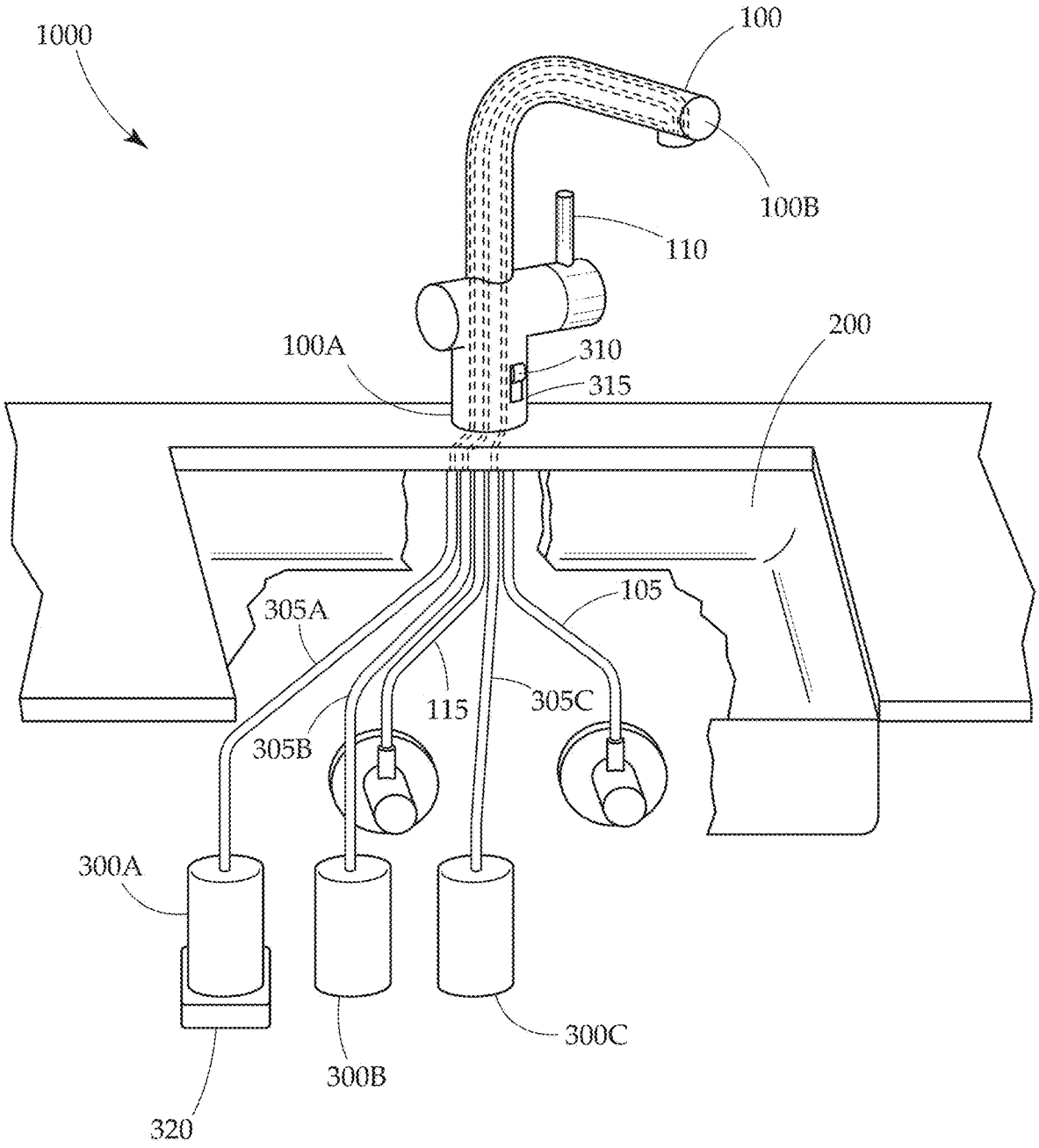
FIG. 1 shows a multifunctional smart faucet in accordance with aspects and embodiments.

In accordance with aspects and embodiments, one or more reservoirs 300 may include a smart feature that automatically dispenses fluid. Referring to FIG. 1, reservoir 300A has timer 320. Timer 320 may receiver one or more signals from faucet 100 and be in fluid communication with cold water line 105 and hot water line 115. For example, timer 320 may begin a countdown from a predetermined time when faucet 100 is turned on. If timer 320 reaches "00:00" before the water is turned off, timer 320 may briefly block the exit of water from faucet 101 and cause the liquid in reservoir 300A to be dispensed. Alternatively, the liquid in reservoir 300A may be dispensed simultaneously with the flow of water. After dispensation, the liquid in reservoir 300A, timer 320 may reset. The liquid in reservoir 300A may, for example, be dish soap. Thus, timer 320 may act to dispense dish soap such that dish soap is automatically pumped out of faucet 100 when the faucet has been running for a certain amount of time, and soap will continue to be dispensed periodically to facilitate cleaning. By periodically dispensing cleaning agent, the user does not need to stop the water to get cleaning agent, nor do they need to touch a bottle to obtain cleaning agent. In one embodiment, an alarm such as a flashing light or noise may indicate that soap or other fluid from one of the reservoirs will be dispensed. In some embodiments, different alarms may activate for different reservoirs, to inform a user of what is coming.

In some embodiments and as shown in FIG. 1, faucet 100 may include manual push button 310. Manual push button 310 slides within groove 315 and, depending on its position in groove 315, communicates with one of channels 305A, 305B, and 305C. When positioned to communicate with a corresponding channel and pushed inward, depression of push button 310 causes pumping of fluid from the corresponding reservoir through the corresponding channel and out of faucet 100. Other push button configurations will be readily selected by those of skill in the art.

Push button 310 also communicates with water lines 105 and 110. Depression of push button 310, in addition to dispensation of a fluid from one of reservoirs 300A, 300B, or 300C, may be configured to cause a temporary stop in water flow (if water is flowing) by, for example, closing of a valve separate than the one or more valves operated by controller 110 that control general water flow. Depression of push button 310 may, for example, activate a valve (not shown) that blocks the flow of water out of faucet 100 at end 100B, though water is flowing through one or both of lines 105 and 115. In this way, dish soap can be readily dispensed during the washing of dishes independent of water flow such that it is now immediately diluted or caused to foam. Similarly, if the faucet is being used to wash dishes and a second individual seeks to clean their hands without causing significant disruption and inconvenience to the user doing the washing, button 310 can be put slid into the sanitizer position and depressed to dispense hand sanitizer from a reservoir 300, allowing the individual to sanitize their hands with only a brief interruption of water flow equal to the duration of push button 310 depression. The valve associated with push button 310 may be deactivated when pressure is released from push button 310 immediately or deactivation may be delayed allowing a user collecting sanitizer, for example, to clear their hands from the faucet before water again begins to flow.

In some embodiments, groove 315 may further include a position for push button 310 where depression of the button dispenses without activation of the valve the stops waterflow. This feature provides a user with the option of having soap dispensed from a reservoir 300 mix with water flowing from lines 105 and 115 as it exits faucet 100 at 100B, providing a soapy solution.

Referring now to FIG. 2, another embodiment of a multifunctional faucet system is shown. FIG. 2 shows multifunctional smart faucet system 1010 having faucet 101. Reservoirs 300A, 300B, and 300C sit in housing 400. Housing 400 further includes computer system 500. Computer system 500 communicates with reservoirs 300A, 300B, and 300C, and in some embodiments, may communicate with cold water line 105 and hot water line 115. This computer system 500 allows for electronic control of valves and dispensing controls such as one or more pumps, including for example, a pump associated with each reservoir 300A, 300B, and 300C, and valves positioned at one or more locations of lines 105 and 115. Computer system 500 may include one or more general purpose computers and may include one or more processors typically connected to one or more memory devices, which can comprise, for example, any one or more of a disk drive memory, a flash memory device, a RAM memory device, or other device for storing data. The memory is typically used for storing programs and data during operation of the disclosed closed loop system. For example, the memory may be used for storing historical data relating to the parameters over a period of time, as well as operating data. Software, including programming code that implements embodiments of the disclosure, can be stored on a computer readable and/or writeable nonvolatile recording medium, and then typically copied into memory wherein it can then be executed by one or more processors. Such programming code may be written in any of a plurality of programming languages, for example, Java, Visual Basic, C, C#, or C++, Fortran, Pascal, Eiffel, Basic, COBAL, or any of a variety of combinations thereof.

Components of the computer system may be coupled by one or more interconnection mechanisms, which may include one or more busses, e.g., between components that are integrated within a same device, and/or a network, e.g., between components that reside on separate discrete devices. The interconnection mechanism typically enables communications, e.g., data, instructions, to be exchanged between components of the system.

The computer system can also include one or more input devices, for example, a, touch screen interface, and other man-machine interface devices as well as one or more output devices, for example, a display screen. The input device touch screen may be combined with the output device display screen. In addition, the computer system may contain one or more interfaces that can connect the computer system to a communication network, in addition or as an alternative to the network that may be formed by one or more of the components of the system.

Housing 400 may be positioned directly below sink 200. In some embodiments, housing 400 may be mounted to the underside or backside of sink 200. In other embodiments, housing 400 may be fixed to back or side wall the cabinet in which sink 200 is recessed or the housing may rest on a surface below sink 200.

Faucet 101 includes touch screen interface 505 and sensor 510. Although a single sensor 510 is shown, more than one sensor 510 may be included on faucet 510B. Sensor 510 may be a motion sensor, touch sensor, or any other sensor capable of providing feedback to computer system 500. Touch screen 505 and sensor 510 communicate with and send signals to computer system 500. Touch screen 505 may be used to select a program stored in the memory of computer system 500 to operate faucet 101 and reservoirs 300 in a predetermined manner. For example, a user may use touch screen 505 to select a dish washing program stored in the memory of computer 505. The dishwashing program may instruct the reservoir associated with dish soap to dispense dish soap every time motion sensor 510 senses a hand in front of it for more than a given period of time. Alternatively, the dishwashing program may simply instruct the dishwashing reservoir to dispense dish soap in predetermined intervals, similar to in system 1000, not requiring engagement with sensor 510. One or more pre-determined intervals may be selectable via the touch screen interface, allowing a user to determine the frequency with which they would like dish soap dispensed.

Figure 3:
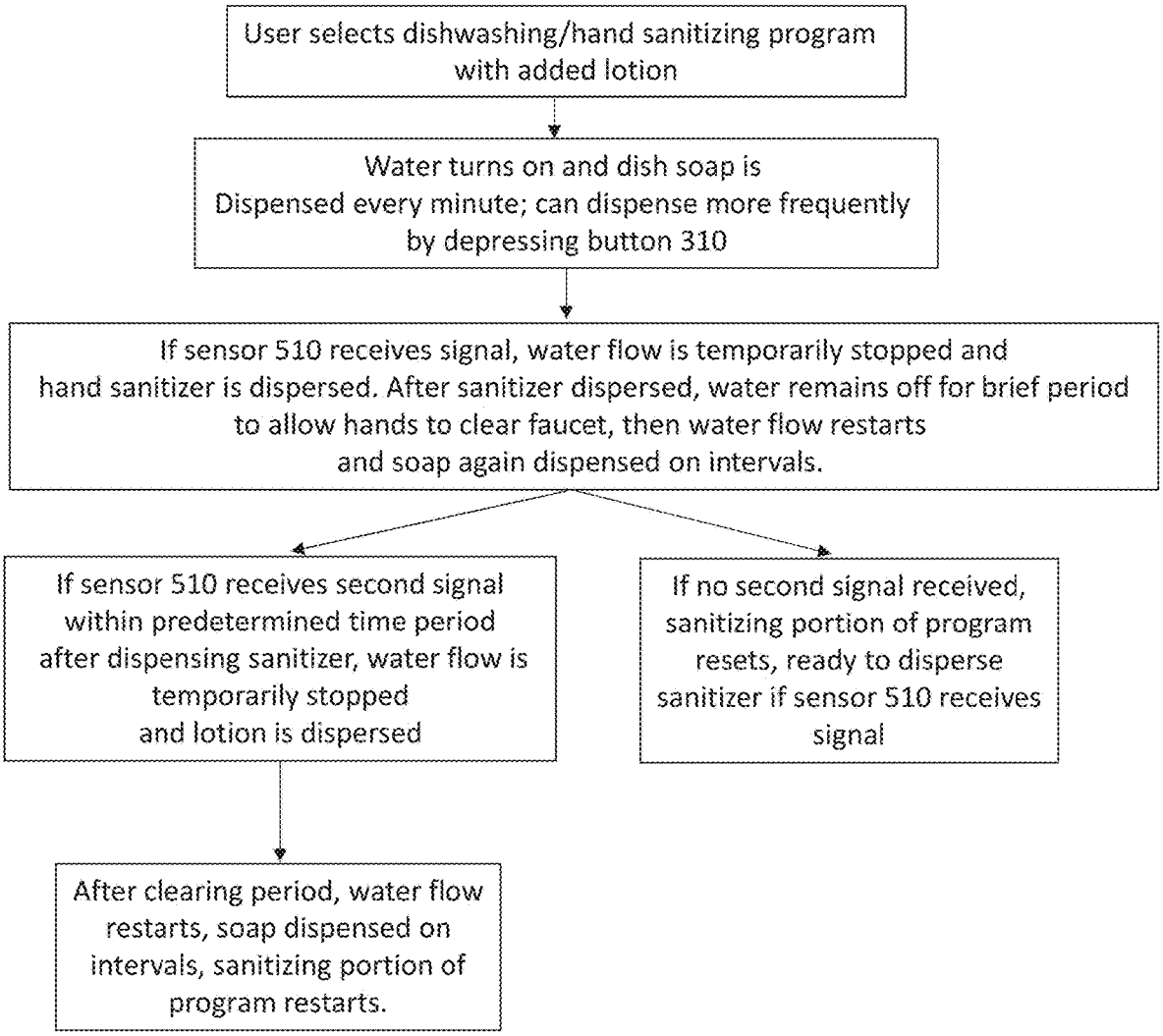
FIG. 3 shows a flow diagram of a multifunctional smart faucet program in accordance with aspects and embodiments.

Additional programs stored on the memory of computer system 500 may be "if, then" programs. For example, a user with a busy household may wish to do dishes or use the sink for an extended period of time while still allowing others in the house the ability to sanitizer their hands. The user may select a program stored in the memory of computer system 500 by engaging with interface 505. Referring to FIG. 3, a user may select a dishwashing program that dispenses sanitizer and hand lotion if sensor 510 receives a given signal. The user may use interface 505 to select the dishwashing/hand sanitizing program with an added lotion option. The selected program may, as discussed above, automatically dispense dish soap on predetermined intervals. Dish soap may be dispensed every minute, every two minutes, every 30 seconds, or on any other periodic interval. If additional soap is needed for washing, the user can use push button 310, set on the dish soap setting, to manually disperse soap in between intervals.

If another member of the household needs to sanitizer their hands, they can do so under the selected program without disrupting the entire dishwashing process. The second user can place their hand in front of sensor 510 such that sensor 510 sends a signal to computer system 500. In accordance with the selected program, the processor of computer system 500 will cause water to stop flowing from faucet 101 by, for example, activation of a valve along water lines 105 and 115, and dispense hand sanitizer from the hand sanitizer reservoir. To avoid inadvertent dispensation of sanitizer and disruption of water flow, the sensor may be required to obtain a "sufficient" signal. That is, the signal to computer system 500 must persist for more than a nominal amount of time. A sufficient signal may be a 0.5 s, 1 s, 2 s, or 3 s. A suitable time period to avoid inadvertent dispensation will be readily selected by those of skill in the art. After dispensation, water may remain off for an additional period of time to allow the user obtaining the sanitizer to clear their hands from faucet 101, for example, 0.5 s, 1 s, or 2 s. A suitable time period to allow hands to be cleared from the faucet without unduly restricting waterflow will be readily selected by those of skill in the art. After this clearing time passes, the valve is deactivated and water flow and periodic dispensation of dish soap restarts.

In some embodiments and as shown in FIG. 3, the selected program may facilitate a second dispensation of a different fluid to the second user, such as hand lotion. Still referring to FIG. 3, if sensor 510 receives a second sufficient signal within a predetermined time period after having dispensed hand sanitizer, the second signal may cause computer system 500 to again stop water flow and dispense hand lotion. If no second signal is received, the dishwashing program will continue to run and the hand sanitizing portion of the program will reset, ready to dispense sanitizer if a new, sufficient, signal is received by sensor 510.

Computer system 500 may further include on board sensors that facilitate proper function of system 1010. For example, computer system 500 may have sensors that communicate with computer system 500 to signal when liquids within reservoirs 300 are running low. Computer system 500 may send a visual signal to interface 505, such as a "fluid low" display or a red light to alert a user that a given reservoir requires refilling. Similarly, computer system 500 may alert a user when a component of the system is not functioning properly. Computer system 500 may, for example, include sensors that provide feedback that enable computer system 500 to determine when a channel 305 is clogged and/or when a plumbing leak is occurring. Computer system 500 may output a signal that alerts the user that action must be taken to avoid additional malfunction.

Figure 4:
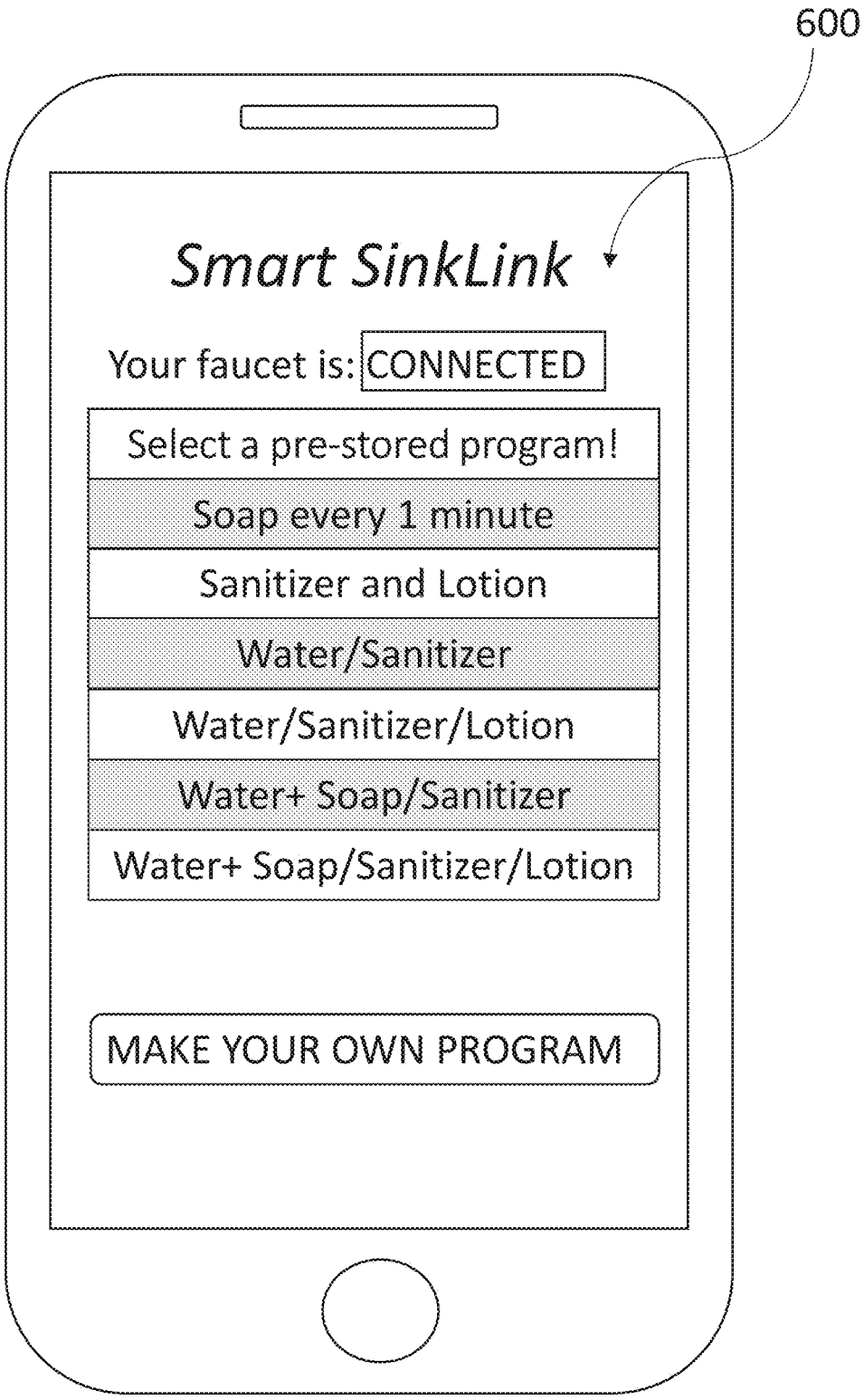
FIG. 4 shows an interface of multifunctional smart faucet smart phone application in accordance with aspects and embodiments.

In some embodiments, the disclosed multifunctional smart faucet systems may be capable of being controlled by an external, wireless device via a wireless communication. Methods of connecting faucet 100 to smart devices and/or external computers will be readily understood by those of skill in the art. For example, the disclosed faucets, and more specifically, onboard computer system 500, may communicate with a smart phone application over a wireless network. A user may install on their smart phone or other smart device an application that allows smart faucet 100B to operate in response to signals sent to system 1010 from the smart phone via the application. Referring to FIG. 4, application 600 may allow a user to select programs stored on the memory of computer system 500 or may allow a user to create their own programs that computer system 500 can be instructed to execute, which in turn cause faucet 100 to dispense fluids from reservoirs 300. The application may further enable a user to review and/or troubleshoot components of the system. The application may provide alerts to a user when reservoir fluid levels are low, when channels are clogged, or when other parts of the system need attention.

Although certain representative embodiments and advantages have been described in detail, it will be apparent to those skilled in the art that various modifications and variations can be made in the present disclosure without departing from the scope or spirit of the disclosure. Other embodiments of the disclosure will be apparent to those skilled in the art from consideration of the specification and practice of the systems, processes, and methods disclosed herein. It is intended that the specification and examples be considered as exemplary only.

What is claimed is:

1. A faucet system comprising:

a faucet, the faucet comprising a body having a base and a dispensing end;

at least three reservoirs;

each of the three reservoirs having a reservoir channel extending from the reservoir through the body of the faucet to the dispensing end;

a hot water line and a cold water line extending through the body of the faucet to the dispensing end;

a push button capable of communication with each of the reservoir channels, the hot water line, and the cold water line; and wherein the push button slides into at least three positions, each of the three positions corresponding to one of the three reservoirs, and each of the three reservoirs containing a different dispensing fluid.

2. The faucet system of claim 1, further comprising a computer system in communication with the plurality of reservoirs, the computer system comprising a memory and a processor, the processor configured such that execute at least one faucet system operation program stored on the memory.

3. The faucet system of claim 2, wherein the computer system and plurality of reservoirs are positioned in a housing.

4. The faucet system of claim 3, the faucet further comprising an interface in communication with the computer system.

5. The faucet system of claim 4, wherein the at least one program is selected for operation by use of the interface.

6. The faucet system of claim 5, wherein the at least one program includes a dishwashing program.

7. The faucet system of claim 6, wherein the dishwashing program periodically dispenses fluid from one of the three reservoirs.

8. The faucet system of claim 7, wherein the system has three reservoirs each containing one of dish soap, hand sanitizer, and hand lotion.

9. The faucet system of claim 7, wherein the system has four reservoirs each containing one of dish soap, hand soap, hand sanitizer, and hand lotion.

10. The faucet system of claim 1, wherein at least one reservoir has a timer, and the timer is in communication with the reservoir's corresponding reservoir channel, the hot water line, and the cold water line.

11. The faucet system of claim 10, wherein when a flow of water is flowing through the at least one of the hot water line or the cold water line, the timer causes a dispensing of fluid in the reservoir at periodic intervals.

12. The faucet system of claim 11, wherein the dispensing of the fluid occurs simultaneously with the flow of water.

13. The faucet system of claim 11, wherein the timer stops the flow of water.

14. The faucet system of claim 13, wherein the flow of water restarts after the dispensing of the fluid is complete.

15. The faucet system of claim 1, wherein depression of the push button causes dispensing of the fluid in the corresponding reservoir.

16. The faucet system of claim 2, wherein the computer system is controllable by an application run from a wireless device.

17. The faucet system of claim 16, wherein the wireless device is a smart phone.

18. A faucet system comprising:

a faucet, the faucet comprising a body having a base and a dispensing end;

a plurality of reservoirs;

each of the plurality of reservoirs having a reservoir channel extending from the reservoir through the body of the faucet to the dispensing end;

a hot water line and a cold water line extending through the body of the faucet to the dispensing end;

a push button capable of communication with each of the reservoir channels, the hot water line, and the cold water line; and wherein the push button slides into a plurality of positions, each position corresponding to one of the plurality of reservoirs, and depression of the push button causes dispensing of a fluid in the corresponding reservoir.

* * * * *